US008985420B2

(12) United States Patent
Dapkins, Jr. et al.

(10) Patent No.: US 8,985,420 B2
(45) Date of Patent: Mar. 24, 2015

(54) TACTICAL CARRYING PACK

(75) Inventors: John A. Dapkins, Jr., Bloomsbury, NJ (US); Nicholas I. Klementowicz, III, Hillsborough, NJ (US); Kenneth P. Glynn, Flemington, NJ (US)

(73) Assignee: Jersey Tactical Corp., Lopatcong, NJ (US)

( * ) Notice: Subject to any disclaimer, the term of this patent is extended or adjusted under 35 U.S.C. 154(b) by 1258 days.

(21) Appl. No.: 12/077,482

(22) Filed: Mar. 19, 2008

(65) Prior Publication Data

US 2009/0236383 A1 Sep. 24, 2009

(51) Int. Cl.

| | |
|---|---|
| ***A45F 3/04*** | (2006.01) |
| ***A45F 3/08*** | (2006.01) |
| ***A45F 3/10*** | (2006.01) |
| ***A45F 3/14*** | (2006.01) |
| ***A45F 5/00*** | (2006.01) |

(52) U.S. Cl.

CPC ... *A45F 3/04* (2013.01); *A45F 3/08* (2013.01); *A45F 3/10* (2013.01); *A45F 3/14* (2013.01); *A45F 5/00* (2013.01); *A45F 2003/144* (2013.01); *A45F 2003/148* (2013.01); *A45F 2005/002* (2013.01)

USPC ..... 224/579; 224/628; 224/645; 224/578

(58) Field of Classification Search

USPC ..... 224/265, 627, 578–580, 259, 628, 631, 224/645, 646

See application file for complete search history.

(56) References Cited

U.S. PATENT DOCUMENTS

| | | | | | |
|---|---|---|---|---|---|
| 3,649,921 | A | | 3/1972 | Thomas | |
| 5,074,222 | A | * | 12/1991 | Welch | 108/43 |
| 5,400,683 | A | * | 3/1995 | LaFlame | 84/421 |
| 5,577,652 | A | | 11/1996 | Cooper | |
| 5,630,536 | A | * | 5/1997 | Bugnaski | 224/600 |
| 5,984,157 | A | * | 11/1999 | Swetish | 224/631 |
| 5,988,474 | A | | 11/1999 | Smith, II et al. | |
| 6,006,974 | A | * | 12/1999 | Varney et al. | 224/645 |
| 6,138,881 | A | * | 10/2000 | Paul et al. | 224/153 |
| 6,793,112 | B2 | | 9/2004 | Ammerman | |
| 6,837,409 | B2 | | 1/2005 | Lemanski, II | |

(Continued)

*Primary Examiner* — Brian D Nash
*Assistant Examiner* — Corey Skurdal
(74) *Attorney, Agent, or Firm* — Ernest D. Buff & Assoc.; Ernest D. Buff; Harry Anagnos

(57) ABSTRACT

The present invention is directed to a tactical carrying pack for back-supported transport of a payload, comprising a vertical base plate having a front and a back and having an upright support connection section thereon. There is also a left shoulder bar having a top portion and a bottom portion, the top portion of the left shoulder bar extending forward in an inverted hook shape for hooking over a shoulder. The left shoulder bar is hingedly connected at its bottom portion to the upright support connection section so as to at least rotate through an arc from a first position to a second position and from the second position to the first position. The first position is a substantially vertical position and the second position is a non-vertical position. There is also a right shoulder bar having a top portion and a bottom portion, the top portion of the right shoulder bar extending forward in an inverted hook shape for hooking over a shoulder. The right shoulder bar is hingedly connected similarly to the right shoulder bar. There is a payload-receiving member connected to the vertical base plate extending rearward away from the vertical base plate back for supporting a payload in which a user may hook the shoulder bars over one or both shoulders.

16 Claims, 8 Drawing Sheets

(56) References Cited

U.S. PATENT DOCUMENTS

| | | | | |
|---|---|---|---|---|
| 6,883,691 | B2 | 4/2005 | Pratt et al. | |
| 7,100,809 | B2 | 9/2006 | Arnold et al. | |
| 2004/0256426 | A1* | 12/2004 | Sanderson et al. | 224/201 |
| 2006/0175365 | A1* | 8/2006 | Sandler | 224/201 |
| 2007/0175940 | A1* | 8/2007 | Sacks | 224/579 |
| 2008/0035693 | A1* | 2/2008 | Lee | 224/578 |

* cited by examiner

TACTICAL CARRYING PACK

BACKGROUND OF INVENTION a. Field of Invention

The invention relates generally to tactical carrying packs for back-supported transport of a payload. More specifically, the present invention relates to carrying packs having a vertical base plate with an upright support connection allowing for shoulder placement of the device, on one or both shoulders, by hinged arcing of shoulder bars connected to the upright support connection.

b. Description of Related Art

The following patents are representative of various types of carrying pack devices:

U.S. Pat. No. 7,100,809 B2 to Arnold et al. describes a carrying bag, which comprises a receiving container for receiving objects to be taken along, and a carrying device connected to the receiving container. The carrying device is decoupled in its movements from the receiving container by the provision of string lines which can be displaced in the direction marked by the arrows.

U.S. Pat. No. 6,883,691 B2 to Pratt et al. describes the present invention which features a unique carrying device for carrying a cartable item, wherein the carrying device is formed of a rigid structure and comprises means for engaging a first shoulder of a user, means for engaging a second shoulder of a user, means for connecting the means for engaging the first and second shoulders of a user together, means for adjusting the ergonomic configuration of the carrying device, means for releasably coupling or attaching the carrying device to a golf bag, and means for transitioning, upon elective actuation, functions to transition or convert the carrying device from a single-shoulder carrying arrangement or position to a dual-shoulder carrying arrangement or position.

U.S. Pat. No. 6,837,409 B2 to Lemanski, II describes a pack system having a suspension system with a waist belt which slidably carries a bag or pack. At least one shoulder strap extends between the top of the bag and the side of the bag. A compression suspension system attaches to the pack at multiple locations and is adjustable to stabilize the pack in a comfortable position to accommodate varying loads. The system allows the pack to be shifted or rotated around the body of the wearer between frontal access or rear carrying position for comfort and accessibility.

U.S. Pat. No. 6,793,112 B2 to Ammerman describes a shoulder carrier having at least one shoulder strap connected to a container. A connection point between the shoulder strap and the container may be moved laterally without disconnecting the strap from the container.

U.S. Pat. No. 5,988,475 to Han describes a dual shoulder trap device attachable to a standard golf bag to allow a golfer to carry the golf bag centered on his back. For example, the dual shoulder strap device is made from a single piece to prevent twisting and entangling of the two separate shoulder straps. Alternatively, the dual shoulder straps are connected to tracks built into a coupler, in which the tracks allow the shoulder straps to be adjustable to the differing widths of the golfer's shoulders.

U.S. Pat. No. 5,577,652 to Cooper describes a convertible back pack having an anchoring loop centrally disposed near the top of the back pack on a back panel. A single shoulder strap connected to the back pack at both ends and passing slidably through the anchoring loop at its middle dividing the shoulder strap into a left portion and a right portion. Accordingly, the back pack can be easily converted from double shoulder wear, to single shoulder wear, to across the chest wear.

U.S. Pat. No. 3,649,921 to Thomas describes a back pack harness wherein a pressure plate effects the encircling action of shoulder hooks and a waist belt in order to permit the fastening of a back pack to the back of an individual by using only one hand. A controlled deformation belt for use about the waist of the user of the back pack.

SUMMARY OF THE INVENTION

The present invention is directed to a tactical carrying pack for back-supported transport of a payload, comprising a vertical base plate having a front and a back and having an upright support connection section thereon. There is also a left shoulder bar having a top portion and a bottom portion, the top portion of the left shoulder bar extending forward in an inverted hook shape for hooking over a shoulder. The left shoulder bar is hingedly connected at its bottom portion to the upright support connection section so as to at least rotate through an arc from a first position to a second position and from the second position to the first position. The first position is a substantially vertical position and the second position is a non-vertical position. The left shoulder bar is selected from the group consisting of a semi-flexible shoulder bar and a rigid shoulder bar.

There is also a right shoulder bar having a top portion and a bottom portion, the top portion of the right shoulder bar extending forward in an inverted hook shape for hooking over a shoulder. The right shoulder bar is hingedly connected at its bottom portion to the upright support connection section so as to at least rotate through an arc from a first position to a second position and from the second position to the first position. The first position is a substantially vertical position and the second position is a non-vertical position. The right shoulder bar is selected from the group consisting of a semi-flexible shoulder bar and a rigid shoulder bar.

In addition, there is a payload-receiving member connected to the vertical base plate extending rearward away from the vertical base plate back for supporting a payload in which a user may (1) position the right shoulder bar and the left shoulder bar in their respective first positions so as to be vertical and adjacent one another to function as a single shoulder bar that may be hooked over either a left shoulder or a right shoulder, but not both shoulders simultaneously, and a user may (2) position the right shoulder bar and the left shoulder bar in their respective second positions so as to be non-vertical and apart from one another to function as a two-shoulder bar that may be hooked over both a left shoulder and a right shoulder simultaneously.

In some preferred embodiments of the present invention tactical carrying pack for back-supported transport of a payload, the tactical carrying pack is constructed of material selected from the group consisting of metal, plastic, fiberglass and combinations thereof.

In some preferred embodiments of the present invention tactical carrying pack for back-supported transport of a payload, the tactical carrying pack left shoulder bar and right shoulder bar each have straps that extend from their top portions to at least one of the vertical base plate and the payload-receiving member.

In other preferred embodiments of the present invention tactical carrying pack for back-supported transport of a payload, the tactical carrying pack straps include strap length adjustment means.

In some preferred embodiments of the present invention tactical carrying pack for back-supported transport of a payload, at least one of the left shoulder bar and the right shoulder bar includes a connecting means for connecting the left shoulder bar and the right shoulder bar to one another when they are in their respective first positions so as to inhibit separation from one another.

In other preferred embodiments of the present invention tactical carrying pack for back-supported transport of a payload, the payload-receiving member includes at least one circular recess for receiving a cylindrical payload.

In other preferred embodiments of the present invention tactical carrying pack for back-supported transport of a payload, the payload-receiving member includes a walled storage area.

In other preferred embodiments of the present invention tactical carrying pack for back-supported transport of a payload, the payload-receiving member includes a ledge for receiving a back pack or other payload capable of resting on a flat bottom.

In some preferred embodiments of the present invention tactical carrying pack for back-supported transport of a payload, the left shoulder bar and the right shoulder bar include flexible padding at least in shoulder contacting areas.

In other preferred embodiments of the present invention tactical carrying pack for back-supported transport of a payload wherein said vertical base plate includes a user back pad on its front.

In another preferred embodiment of the present invention tactical carrying pack for back-supported transport of a payload, the device comprises a vertical base plate having a front and a back and having a left upright support connection section thereon and a right upright support connection thereon in which the left upright support connection and the right upright support connection are separate from one another. There is also a left shoulder bar having a top portion and a bottom portion, the top portion of the left shoulder bar extending forward in an inverted hook shape for hooking over a shoulder. The left shoulder bar is hingedly connected at its bottom portion to the upright support connection section so as to at least rotate through an arc from a first position to a second position and from the second position to the first position. The first position is a substantially vertical position and the second position is a non-vertical position. The left shoulder bar is selected from the group consisting of a semi-flexible shoulder bar and a rigid shoulder bar.

There is also a right shoulder bar having a top portion and a bottom portion, the top portion of the right shoulder bar extending forward in an inverted hook shape for hooking over a shoulder. The right shoulder bar is hingedly connected at its bottom portion to the upright support connection section so as to at least rotate through an arc from a first position to a second position and from the second position to the first position. The first position is a substantially vertical position and the second position is a non-vertical position. The right shoulder bar is selected from the group consisting of a semi-flexible shoulder bar and a rigid shoulder bar; and, In addition, there is a payload-receiving member connected to the vertical base plate extending rearward away from the vertical base plate back for supporting a payload in which a user may (1) position the right shoulder bar and the left shoulder bar in their respective first positions so as to be vertical and adjacent one another to function as a single shoulder bar that may be hooked over either a left shoulder or a right shoulder, but not both shoulders simultaneously, and a user may (2) position the right shoulder bar and the left shoulder bar in their respective second positions so as to be non-vertical and apart from one another to function as a two-shoulder bar that may be hooked over both a left shoulder and a right shoulder simultaneously.

In some preferred embodiments of the present invention tactical carrying pack for back-supported transport of a payload, the tactical carrying pack is constructed of material selected from the group consisting of metal, plastic, fiberglass and combinations thereof.

In some preferred embodiments of the present invention tactical carrying pack for back-supported transport of a payload, the tactical carrying pack left shoulder bar and right shoulder bar each have straps that extend from their top portions to at least one of the vertical base plate and the payload-receiving member.

In other preferred embodiments of the present invention tactical carrying pack for back-supported transport of a payload, the tactical carrying pack straps include strap length adjustment means.

In some preferred embodiments of the present invention tactical carrying pack for back-supported transport of a payload, at least one of the left shoulder bar and the right shoulder bar includes a connecting means for connecting the left shoulder bar and the right shoulder bar to one another when they are in their respective first positions so as to inhibit separation from one another.

In other preferred embodiments of the present invention tactical carrying pack for back-supported transport of a payload, the payload-receiving member includes at least one circular recess for receiving a cylindrical payload.

In other preferred embodiments of the present invention tactical carrying pack for back-supported transport of a payload, the payload-receiving member includes a walled storage area.

In other preferred embodiments of the present invention tactical carrying pack for back-supported transport of a payload, the payload-receiving member includes a ledge for receiving a back pack or other payload capable of resting on a flat bottom.

In some preferred embodiments of the present invention tactical carrying pack for back-supported transport of a payload, the left shoulder bar and the right shoulder bar include flexible padding at least in shoulder contacting areas.

In other preferred embodiments of the present invention tactical carrying pack for back-supported transport of a payload wherein said vertical base plate includes a user back pad on its front.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
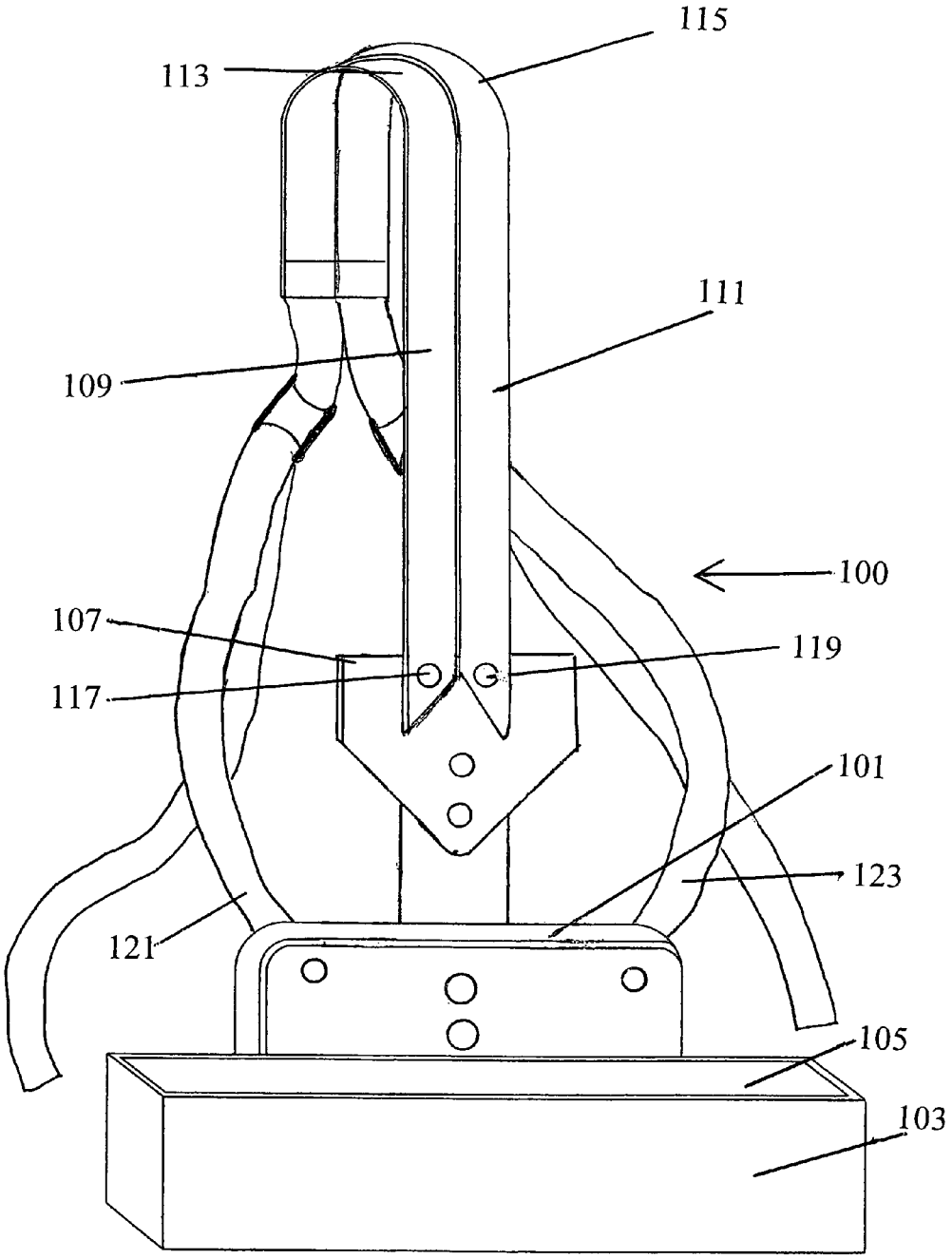
FIG. 1 is a back view of one embodiment of a present invention tactical carrying pack wherein both shoulder bars are vertical and contiguous for one shoulder payload transport.

The present invention relates to tactical carrying packs for back-supported transport of a payload in which there is a vertical base plate, a left shoulder bar, a right shoulder bar and a payload-receiving member. The left shoulder bar and the right shoulder bar are non-flexible being made from a rigid semi-flexible material.

There are two main embodiments, the first having the vertical base plate with a single upright support connection section for providing rotation of the left shoulder bar and the right shoulder bar from a substantially vertical position of each of the left and right shoulder bars to a non-vertical position. In the substantially vertical position, the bars are together for one shoulder payload support while in the non-vertical position, the bars are separated for two shoulder payload support. In the first embodiment, there is flexible padding on the front and the back of the left shoulder bar and the right shoulder bar.

The second embodiment has the vertical base plate with a left upright support connection section and a right upright support connection section in which the left upright support connection section is separate from the right upright support connection section, and vice versa. In effect, the left upright support connection section and the right upright support connection section function as the upright support connection section described in the first embodiment herein above. The separate support connection sections provide for an extremely stable distribution of the payload weight when the tactical carrying pack is in a one-shoulder transport position. Furthermore, this embodiment includes a flexible padding located on the back of the left shoulder bar and the right shoulder bar.

The payload-receiving member may hold a box, a tray, a can, a back pack, a parachute, a shelf, a tent, water supply, a gasoline tank, ram devices, artillery, supplies, or the like. When the payload-receiving member includes a shelf with the appropriate padding, a person or an animal may be carried.

The tactical carrying pack is constructed of material selected from plastic, metal, lightweight aluminum, fiberglass, wood, composite materials such as carbon fiber, or combinations thereof. The device straps like a back pack in which the left shoulder bar and the right shoulder bar wrap over the shoulders while there are back pack straps that wrap under the arms and around the back to connect to the left shoulder bar and the right shoulder bar and one of the vertical base plate and payload-receiving member. In some embodiments, there may be many additional straps which wrap around the chest, waist, or both for carrying related items such as a fire extinguisher, a medical device, a ram device or the like.

The shoulder bars are hingedly connected to the upright support connection section of the vertical base plate by bolts or the like so that the bars may move from a substantially vertical position to a non-vertical position. The hinged connection provides for rotation through an arc from a first position being substantially vertical for placement on one shoulder to a second position being non-vertical for placement on two shoulders.

Referring now in detail to the drawings wherein like reference numerals designate corresponding parts throughout the several views, various embodiments of the present invention are shown.

FIG. 1 shows a back view of present invention tactical carrying pack 100. (This is best seen from the back view as all of its features are exposed from this view.) Carrying pack 100 includes a vertical base plate 101 with an upright support connection section 107. By "vertical" is meant more vertical than horizontal that is, greater than a 60° angle with horizontal. Thus, "vertical" should be construed broadly and may include curvatures or angled to conform to a human low back area, for example, designs that are ergonomic. The device 100 includes a vertical base plate including a front 135, a back (FIG. 1), and an upright support connection section 107.

The upright support connection section 107 has hinge bolts 117 and 119 that are connected to a left shoulder bar 109 and a right shoulder bar 111 at the left shoulder bar bottom portion and the right shoulder bar bottom portion, respectively. The hinge bolts 117 and 119 are thus hingedly connected to upright support connection section 107 and rotate through an arc so as to have a first, vertical position where the left shoulder bar 109 and the right shoulder bar 111 are contiguous, and a second, non-vertical position where the left shoulder bar 109 and the right shoulder bar 111 are apart. In the first position, the tactical carrying pack 100 allows for placement of the tactical carrying pack 100 over one shoulder while in the second position, the tactical carrying pack 100 allows for placement of the tactical carrying pack 100 over two shoulders with the left shoulder bar 109 placed on the left shoulder and the right shoulder bar 111 placed on the right shoulder. FIG. 1 describes and illustrates the position when both shoulder bars are vertical and contiguous for one shoulder payload transport, while FIG. 2 describes and illustrates when both shoulder bars are non-vertical and separated for two shoulder payload transport.

The left shoulder bar 109 includes a top portion 113 and the bottom while the right shoulder bar 111 also includes a top portion 115 and the bottom. The top portions 113 and 115 each extend forward in an inverted hook shape for hooking over a shoulder. Both the left shoulder bar 109 and the right shoulder bar 111 are made from a semi-flexible material, rigid material or the like.

In the embodiment described by FIG. 1, the vertical base plate 101 is composed of three sections which include a substantially triangulated upper support connection section 107, a vertical middle section and an elongated bottom section. A payload-receiving member 103 which is connected to the vertical base plate 101 extends rearward away from the vertical base plate back. In this case, the payload-receiving member 103 includes a back pack 105.

Figure 2:
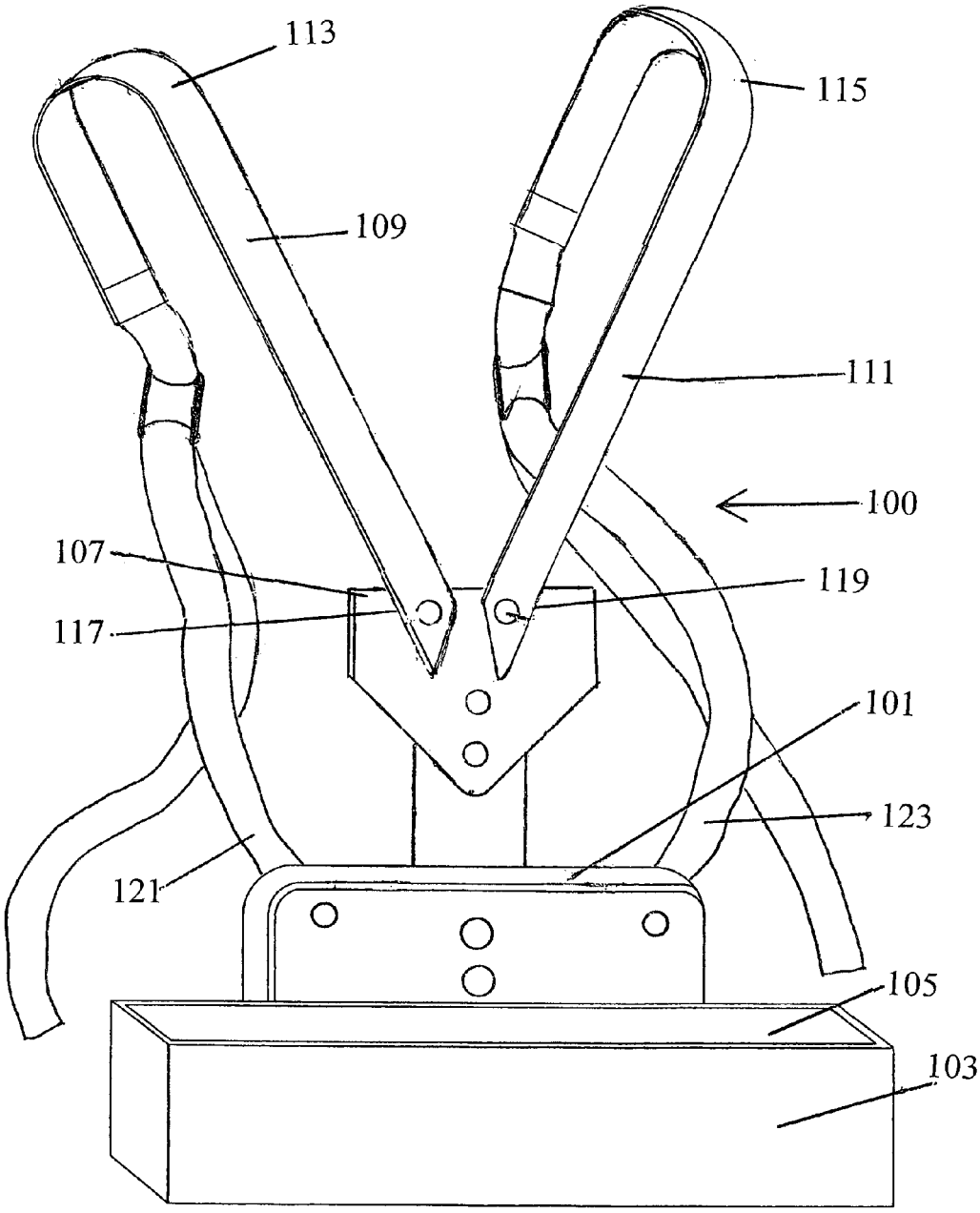
FIG. 2 is a back view of one embodiment of a present invention tactical carrying pack as shown in FIG. 1, but wherein both shoulder bars are non-vertical and separated for two shoulder payload transport.
Figure 3:
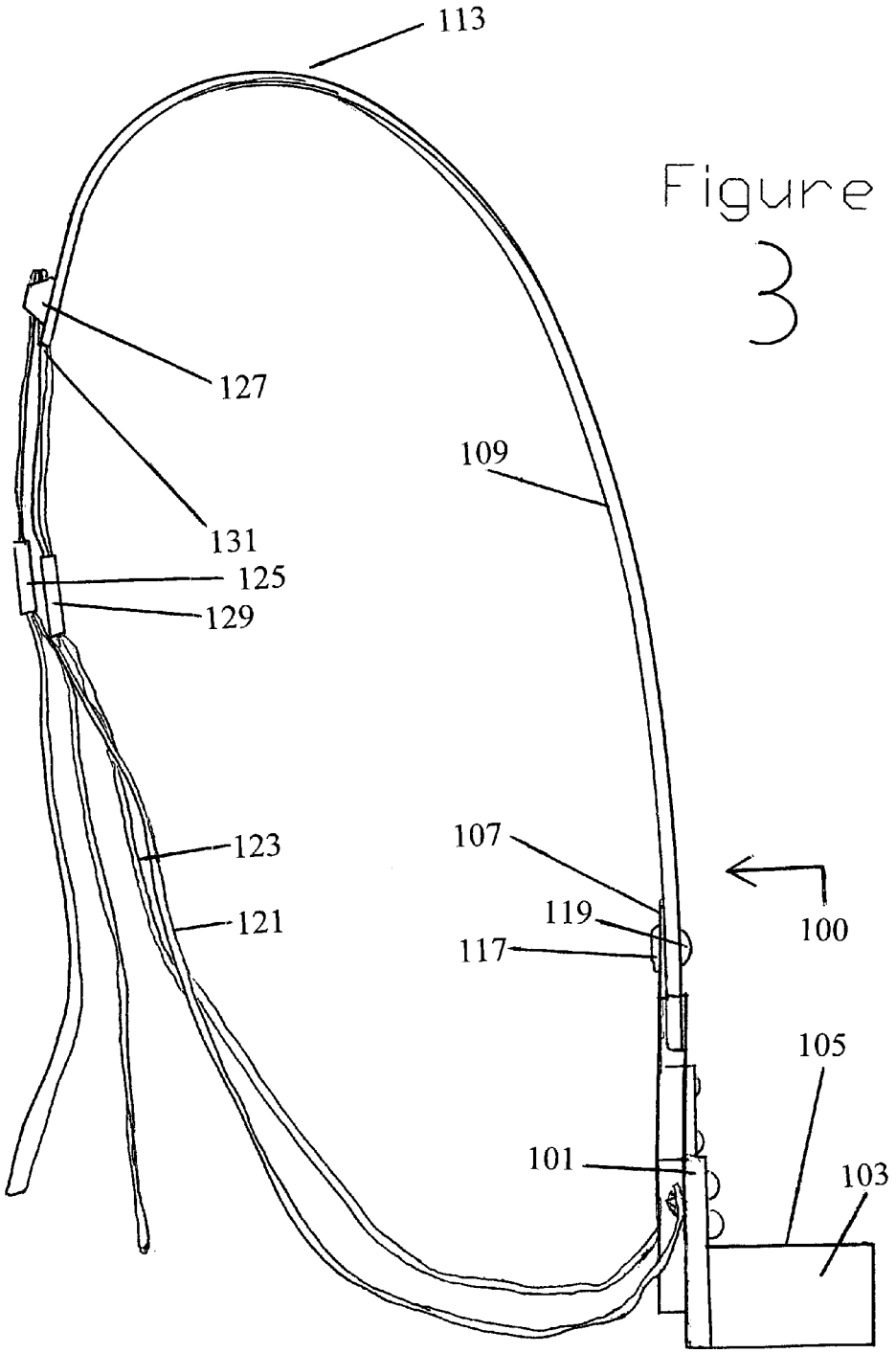
FIG. 3 shows a side view of the present invention tactical carrying pack shown in FIGS. 1 and 2.

Referring now to FIG. 3 which is a side view of the tactical carrying pack shown in FIGS. 1 and 2, the left shoulder bar 109 and the right shoulder bar 111 include a left strap 121 and a right strap 123, respectively for back pack type strapping. The straps 121 and 123 extend from a left shoulder top connection 131 and a right shoulder top connection 133 of the left shoulder bar top 113 and the right shoulder bar top 115, respectively, to at least one of the vertical base plate 107 and the payload-receiving member 105. The straps 121 and 123 include strap length adjustment means 125, 129, respectively, for tightening the straps under the arms and around the back. The left shoulder bar 109 includes connection means 127 for connecting the left shoulder bar 109 and the right shoulder bar 111 to one another when they are in their respective first positions so as to inhibit separation from one another. The connection means 127 includes snap fasteners, hook and loop fasteners, buttons, hooks and eyelets, or the like.

Figure 4:
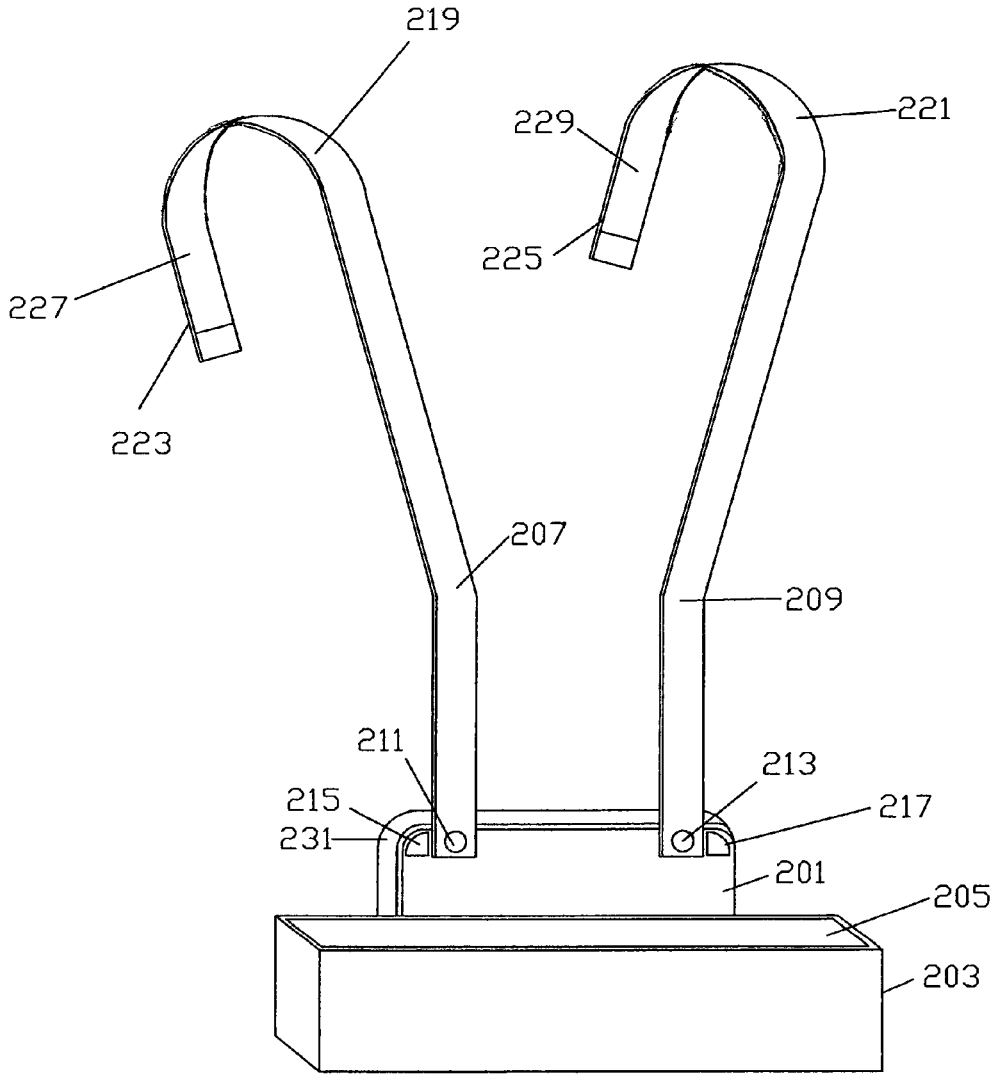
FIG. 4 is a back view of another embodiment of a present invention tactical carrying pack wherein both shoulder bars are non-vertical and separated for two shoulder payload transport, and wherein the shoulder bars are separated from one another at the vertical base plate.
Figure 5:
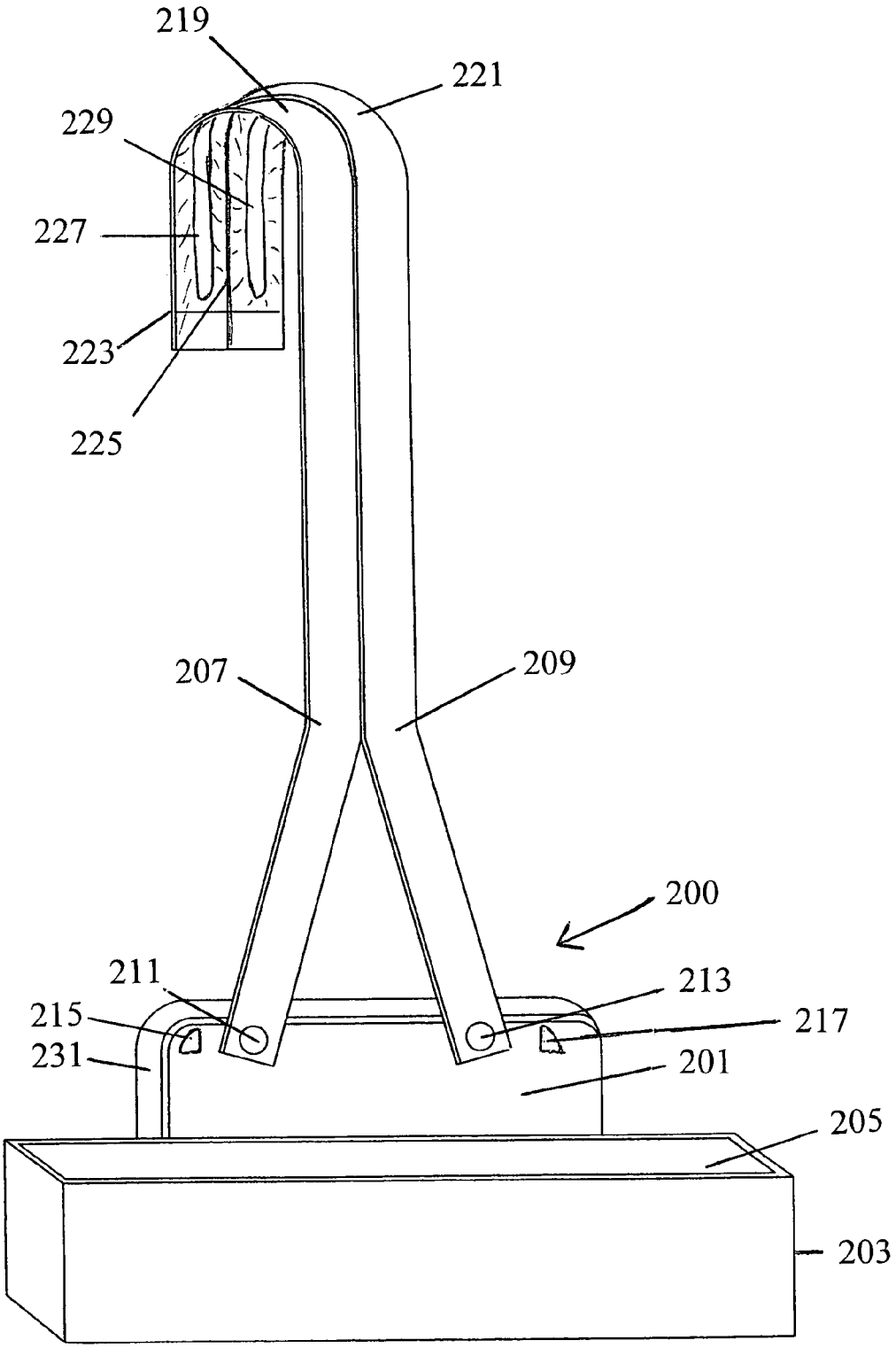
FIG. 5 shows the back view of the FIG. 4 embodiment of a present invention tactical carrying pack, but wherein both shoulder bars are vertical and contiguous for one shoulder payload transport.

FIG. 4 is a back view of another embodiment of a present invention tactical carrying pack wherein both shoulder bars are non-vertical and separated for two shoulder payload transport, and wherein the shoulder bars are separated from one another at the vertical base plate. FIG. 5 shows the back view of the FIG. 4 embodiment of a present invention tactical carrying pack, but wherein both shoulder bars are vertical and contiguous for one shoulder payload transport.

Referring now to FIGS. 4 and 5, there is shown a tactical carrying pack 200 which includes a vertical base plate 201, a left shoulder bar 207, a right shoulder bar 209 and a payload receiving member 203. The vertical base plate 201 includes a front pad 231, a back (shown in FIGS. 4 and 5), a left upright support connection section 215, and a right upright support connection section 217. The left upright support connection section 215 and the right upright support connection section 217 are separate from each other.

The left shoulder bar 207 includes a top portion 219 and a bottom while the right shoulder bar 209 also includes a top portion 221 and a bottom. The top portions 219 and 221 each extend forward in an inverted hook shape for hooking over a shoulder. Both the left shoulder bar 207 and the right shoulder bar 209 are made from a semi-flexible material, rigid material or the like. In addition, there is left flexible padding 227 and right flexible padding 229 at the back of the left shoulder bar 207 and at the back of the right shoulder bar 209, respectively.

The left upright support connection section 215 has a hinge bolt 211 connected to the left shoulder bar 207 at the left shoulder bar bottom portion. The right upright support connection section 217 has a hinge bolt 213 connected to the right shoulder bar 209 at the right shoulder bar bottom portion. The hinge bolts 211 and 213 are thus hingedly connected to each of the left and right upright support connection sections 215 and 217, and each rotate through an arc so as to have a first, vertical position where the left shoulder bar 207 and the right shoulder bar 209 are contiguous, and a second, non-vertical position where the left shoulder bar 207 and the right shoulder bar 209 are apart. In the first position, the tactical carrying pack 200 allows for placement of the tactical carrying pack 200 over one shoulder while in the second position, the tactical carrying pack 200 allows for placement of the tactical carrying pack 200 over two shoulders with the left shoulder bar 207 placed on the left shoulder and the right shoulder bar 209 placed on the right shoulder. FIG. 4 describes and illustrates when both shoulder bars are non-vertical and separated for two shoulder payload transport while FIG. 5 describes and illustrates the position when both shoulder bars are vertical and contiguous for one shoulder payload transport The payload-receiving member 203 which is connected the vertical base plate 201, extends rearward away from the vertical base plate back 201. In this case, the payload-receiving member 203 includes a box having a walled storage area 205.

The left shoulder bar 207 and the right shoulder bar 209 include a left curvature 223 and a right curvature 225, respectively, for obtaining relatively snug fitting over the shoulders facilitate by the padded left shoulder back 227 and the padded right shoulder back 229.

Figure 6:
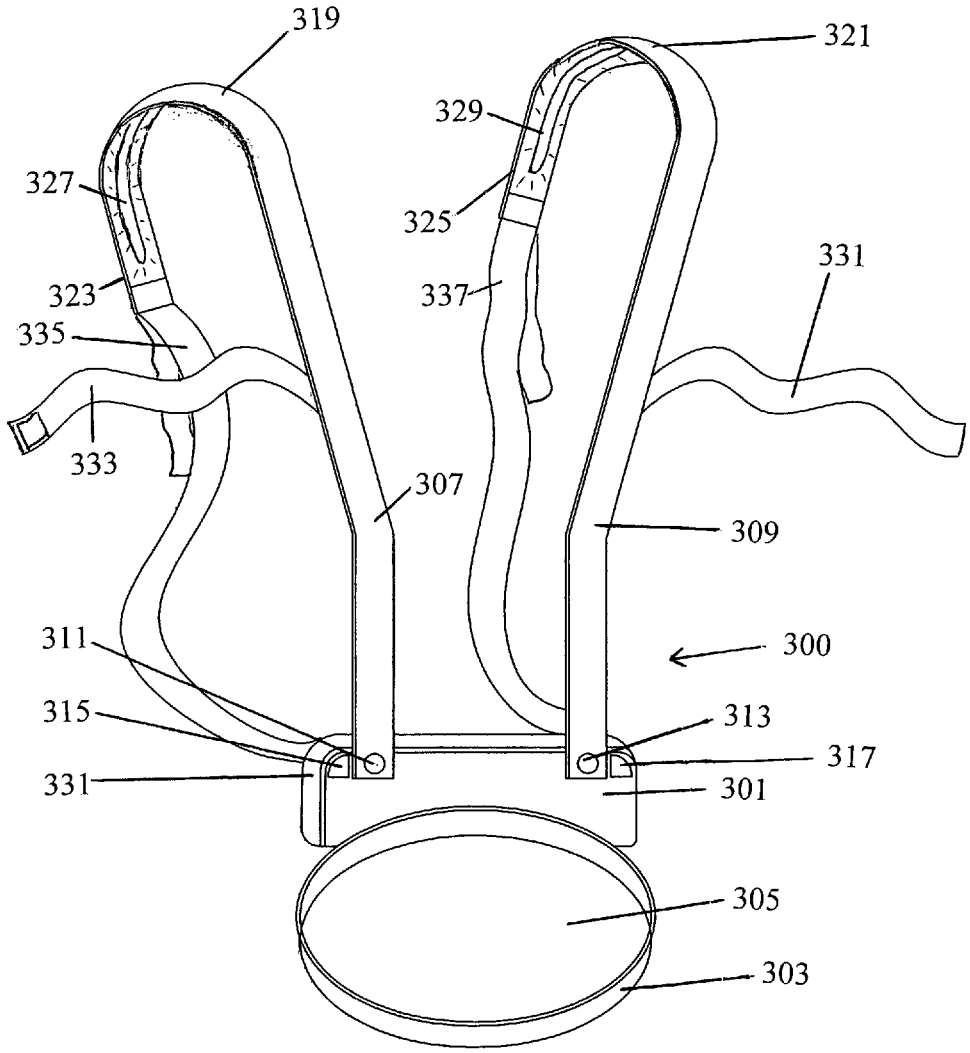
FIG. 6 is a back view of another embodiment of a present invention tactical carrying pack that includes a cylindrical payload-receiving member, and wherein both shoulder bars are non-vertical and separated for two shoulder payload transport, and wherein the shoulder bars are separated from one another at the vertical base plate.

FIG. 6 is a back view of another embodiment of a present invention tactical carrying pack that includes a cylindrical payload-receiving member, and wherein both shoulder bars are non-vertical and separated for two shoulder payload transport, and wherein the shoulder bars are separated from one another at the vertical base plate. Referring now to FIG. 6, a tactical carrying pack includes a vertical base plate 301, a left shoulder bar 307, a right shoulder bar 309 and a payload-receiving member 303. Similar parts as referred to by FIG. 4 are similarly numbered but beginning with "300" and are incorporated herein by reference to the above.

The left shoulder bar 307 and the right shoulder bar 309 include a left strap 335 and a right strap 337, respectively for obtaining back pack type placement of the device 300. The straps 335 and 337 extend from a left shoulder bar top connection 323 and a right shoulder bar top connection 325 of the left shoulder bar top 319 and the right shoulder bar top 321, respectively, to at least one of the vertical base plate 307 and the payload-receiving member 303. The straps 335 and 337 include strap length adjustment means, respectively, for tightening the straps under the arms and around the back.

In this embodiment, there is at least one additional left shoulder strap 333 and at least one additional right shoulder strap 331. The additional straps 333 and 331 wrap around the waist, chest, or both and are connected to each other by connection means 537 and 531. Connection means may be, hook and loop fasteners, snaps, buttons, hooks and eyelets, tying, or the like. They are used to carry peripheral items such as a fire extinguisher, a medical device, a ram device or the like. Moreover, the payload-receiving member 303 includes a cylinder 305 for carrying cylindrical items such as a can, water supply, a gasoline tank, or the like.

Figure 7:
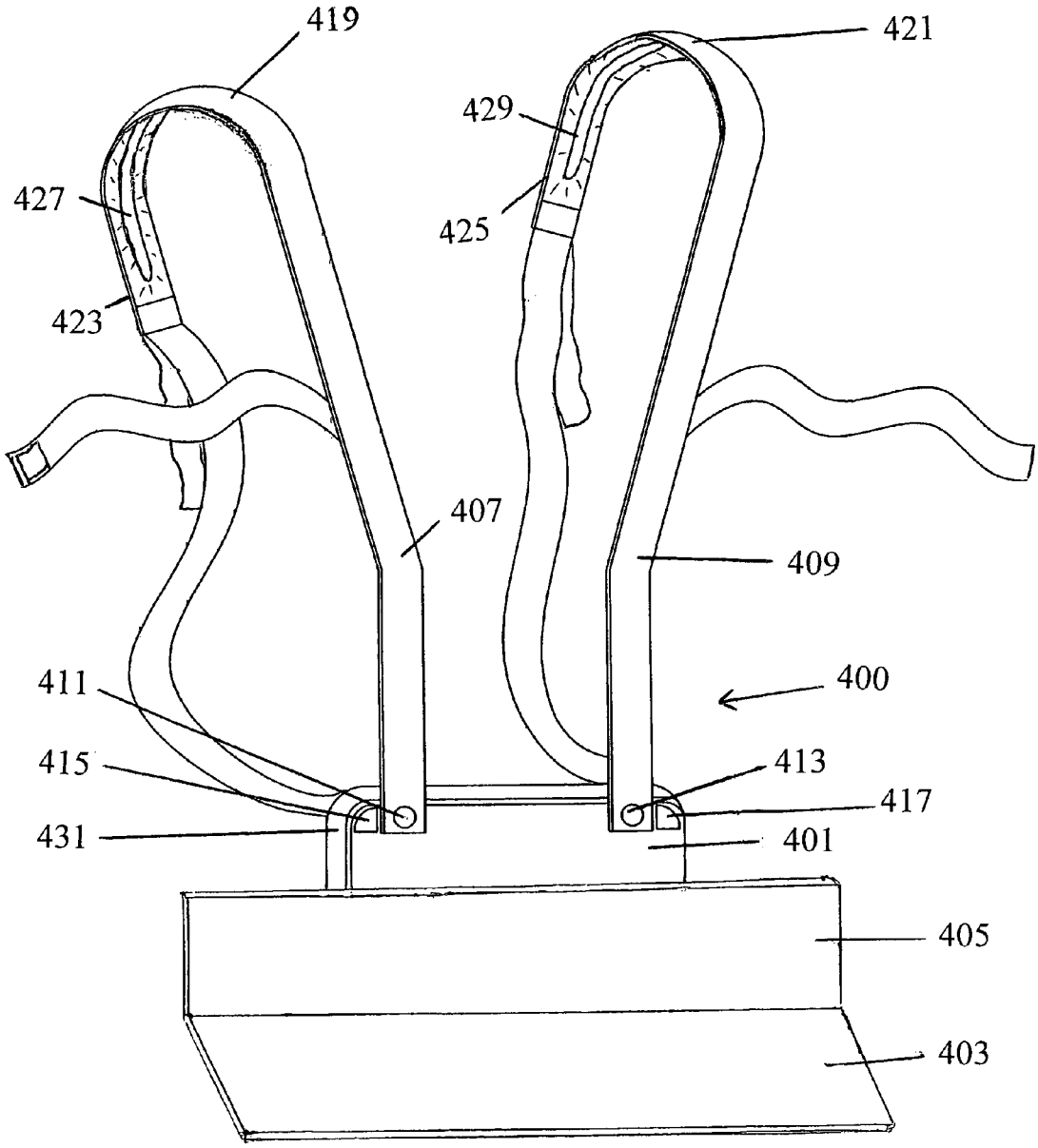
FIG. 7 is a back view of another embodiment of a present invention tactical carrying pack that includes a flat payload-receiving member, and wherein both shoulder bars are non-vertical and separated for two shoulder payload transport, and wherein the shoulder bars are separated from one another at the vertical base plate; and, FIG. 8 is a back view of another embodiment of a present invention tactical carrying pack that includes a payload-receiving member with both flat and recessed cylindrical features, and wherein both shoulder bars are non-vertical and separated for two shoulder payload transport, and wherein the shoulder bars are separated from one another at the vertical base plate.

FIG. 7 is a back view of another embodiment of a present invention tactical carrying pack that includes a flat payload-receiving member, and wherein both shoulder bars are non-vertical and separated for two shoulder payload transport, and wherein the shoulder bars are separated from one another at the vertical base plate. Referring now to FIG. 7, a tactical carrying pack includes a vertical base plate 401, a left shoulder bar 407, a right shoulder bar 409 and a payload-receiving member 403. Similar parts as referred to by FIG. 4 are similarly numbered but beginning with "400" and are incorporated herein by reference to the above.

In this embodiment, the payload-receiving member 403 includes a flat receiving member having a flat bottom or ledge 505, with a back sidewall perpendicular to the ledge 505, and remaining sidewalls open.

Figure 8:
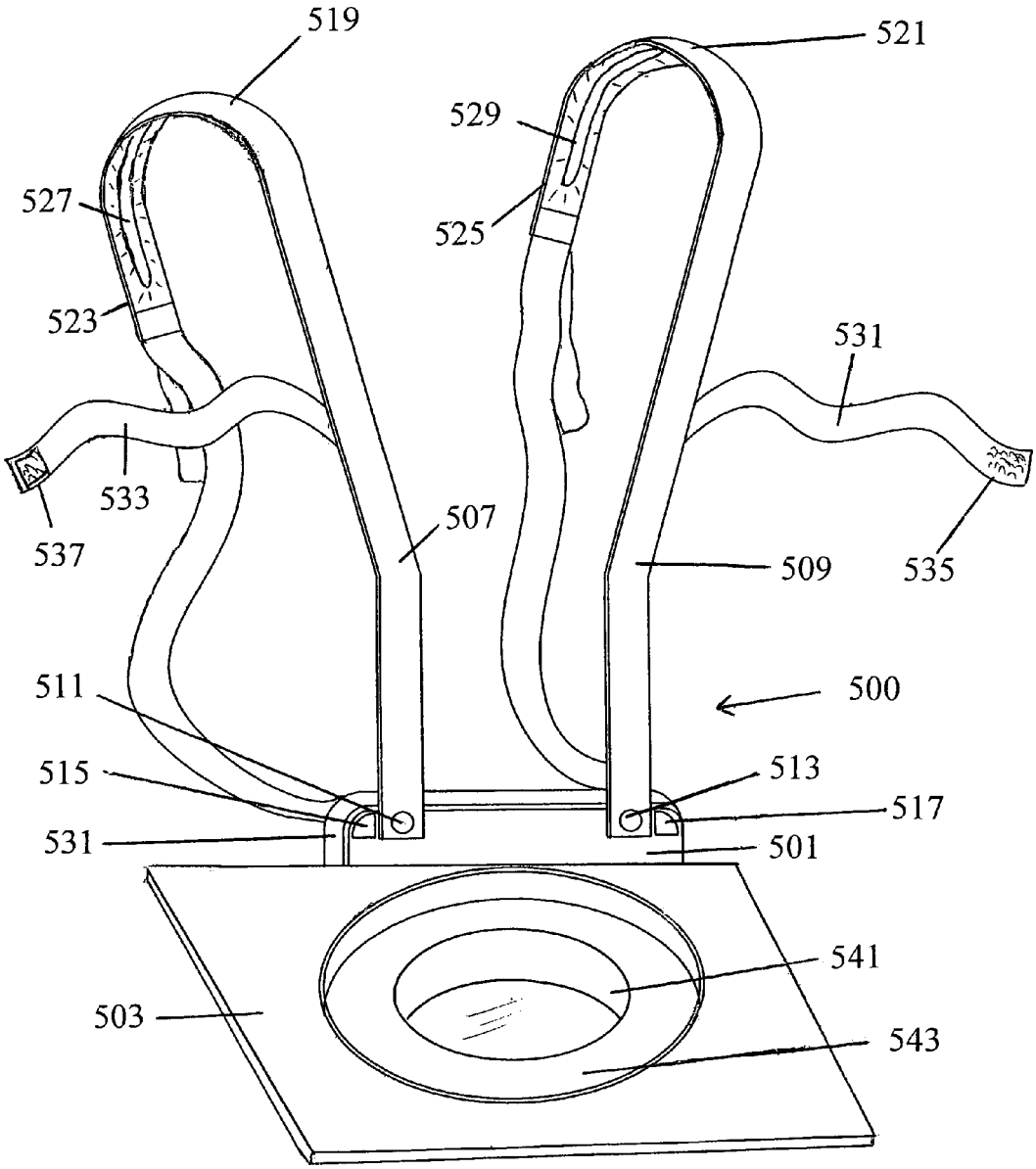

FIG. 8 is a back view of another embodiment of a present invention tactical carrying pack that includes a payload-receiving member with both flat and recessed cylindrical features, and wherein both shoulder bars are non-vertical and separated for two shoulder payload transport, and wherein the shoulder bars are separated from one another at the vertical base plate. Referring now to FIG. 8, a tactical carrying pack includes a vertical base plate 501, a left shoulder bar 507, a right shoulder bar 509 and a payload-receiving member 503. Similar parts as referred to by FIG. 4 are similarly numbered but beginning with "500" and are incorporated herein by reference to the above.

In this embodiment, the payload-receiving member 503 includes at least one flat section 543 and at least one recessed section 541.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A tactical carrying pack for back-supported transport of a payload, comprising:

a) a vertical base plate having a front and a back and having an upright support connection section thereon, said vertical base plate being appointed to be positioned against a user's back;

b) a left shoulder bar having a top portion and a bottom portion, said top portion of said left shoulder bar extending forward in an inverted hook shape for hooking over a shoulder, said left shoulder bar being hingedly connected at its bottom portion to said upright support connection section so as to at least rotate through an arc from a first position to a second position and from said second position to said first position, said first position being a substantially vertical position and said second position being a non-vertical position, said left shoulder bar being selected from the group consisting of a semi-flexible shoulder bar and a rigid shoulder bar, wherein said semi-flexible shoulder bar is rigid enough to maintain said inverted hook shape of said top portion of said left shoulder bar;

c) a right shoulder bar having a top portion and a bottom portion, said top portion of said right shoulder bar extending forward in an inverted hook shape for hooking over a shoulder, said right shoulder bar being hingedly connected at its bottom portion to said upright support connection section so as to at least rotate through an arc from a first position to a second position and from said second position to said first position, said first position being a substantially vertical position and said second position being a non-vertical position, said right shoulder bar being selected from the group consisting of a semi-flexible shoulder bar and a rigid shoulder bar, wherein said semi-flexible shoulder bar is rigid enough to maintain said inverted hook shape of said top portion of said right shoulder bar;

d) a payload-receiving member connected to said vertical base plate extending rearward away from said vertical base plate back for supporting a payload; wherein a user may (1) position said right shoulder bar and said left shoulder bar in their respective first positions so as to be vertical and to make contact with one another in order to function as a single shoulder bar that may be hooked over either a left shoulder or a right shoulder, but not both shoulders simultaneously, and a user may (2) position said right shoulder bar and said left shoulder bar in their respective second positions so as to be non-vertical and apart from one another to function as a two-shoulder bar that may be hooked over both a left shoulder and a right shoulder simultaneously;

e) said tactical carrying pack is constructed of material selected from the group consisting of metal, plastic, fiberglass and combinations thereof;

f) said tactical carrying pack left shoulder bar and right shoulder bar each have straps that extend from their top portions to at least one of said vertical base plate and said payload-receiving member; and g) said payload-receiving member is sufficiently strong to support the weight of a payload, such as a box, a tray, a can, a backpack, a parachute, a shell, a tent, a water supply, a gasoline tank, a ramming device, artillery or the like;

whereby said vertical base plate is positioned against the user's back, so that the tactical carrying pack functions as a back pack capable of providing back-supported transport of a payload.

2. The tactical carrying pack for back-supported transport of a payload of claim 1 wherein said tactical carrying pack straps include strap length adjustment means.

3. The tactical carrying pack for back-supported transport of a payload of claim 1 wherein at least one of said left shoulder bar and said right shoulder bar includes a connecting means for connecting said left shoulder bar and said right shoulder bar to one another when they are in their respective first positions so as to inhibit separation from one another.

4. The tactical carrying pack for back-supported transport of a payload of claim 1 wherein said payload-receiving member includes at least one circular recess for receiving a cylindrical payload.

5. The tactical carrying pack for back-supported transport of a payload of claim 1 wherein said payload-receiving member includes a walled storage area.

6. The tactical carrying pack for back-supported transport of a payload of claim 1 wherein said payload-receiving member includes a ledge for receiving a back pack or other payload capable of resting on a flat bottom.

7. The tactical carrying pack for back-supported transport of a payload of claim 1 wherein said left shoulder bar and said right shoulder bar include flexible padding at least in shoulder contacting areas.

8. The tactical carrying pack for back-supported transport of a payload of claim 1 wherein said vertical base plate includes a user back pad on its front.

9. A tactical carrying pack for back-supported transport of a payload, comprising:

a) a vertical base plate having a front and a back and having a left upright support connection section and a right upright support connection section thereon, said vertical base plate being appointed to be positioned against a user's back, and wherein said left upright support section and said right upright support connection are separate from one another;

b) a left shoulder bar having a top portion and a bottom portion, said top portion of said left shoulder bar extending forward in an inverted hook shape for hooking over a shoulder, said left shoulder bar being hingedly connected at its bottom portion to said left upright support connection section so as to at least rotate through an arc from a first position to a second position and from said second position to said first position, said first position being a substantially vertical position and said second position being a non-vertical position, said left shoulder bar being selected from the group consisting of a semi-flexible shoulder bar and a rigid shoulder bar, wherein said semi-flexible shoulder bar is rigid enough to maintain said inverted hook shape of said top portion of said left shoulder bar;

c) a right shoulder bar having a top portion and a bottom portion, said top portion of said right shoulder bar extending forward in an inverted hook shape for hooking over a shoulder, said right shoulder bar being hingedly connected at its bottom portion to said right upright support connection section so as to at least rotate through an arc from a first position to a second position and from said second position to said first position, said first position being a substantially vertical position and said second position being a non-vertical position, said right shoulder bar being selected from the group consisting of a semi-flexible shoulder bar and a rigid shoulder bar, wherein said semi-flexible shoulder bar is rigid enough to maintain said inverted hook shape of said top portion of said right shoulder bar;

d) a payload-receiving member connected to said vertical base plate extending rearward away from said vertical base plate back for supporting a payload; wherein a user may (1) position said right shoulder bar and said left shoulder bar in their respective first positions so as to be vertical and to make contact with one another in order to function as a single shoulder bar that may be hooked over either a left shoulder or a right shoulder, but not both shoulders simultaneously, and a user may (2) position said right shoulder bar and said left shoulder bar in their respective second positions so as to be non-vertical and apart from one another to function as a two-shoulder bar that may be hooked over both a left shoulder and a right shoulder simultaneously;

e) said tactical carrying pack is constructed of material selected from the group consisting of metal, plastic, fiberglass and combinations thereof;

f) said tactical carrying pack left shoulder bar and right shoulder bar each have straps that extend from their top portions to at least one of said vertical base plate and said payload-receiving member; and g) said payload-receiving member is sufficiently strong to support the weight of a payload, such as a box, a tray, a can, a backpack, a parachute, a shell, a tent, a water supply, a gasoline tank, a ramming device, artillery or the like;

whereby said vertical base plate is positioned against the user's back, so that the tactical carrying pack functions as a back pack capable of providing back-supported transport of a payload.

10. The tactical carrying pack for back-supported transport of a payload of claim 9 wherein said tactical carrying pack straps include strap length adjustment means.

11. The tactical carrying pack for back-supported transport of a payload of claim 9 wherein at least one of said left shoulder bar and said right shoulder bar includes a connecting means for connecting said left shoulder bar and said right shoulder bar to one another when they are in their respective first positions so as to inhibit separation from one another.

12. The tactical carrying pack for back-supported transport of a payload of claim 9 wherein said payload-receiving member includes at least one circular recess for receiving a cylindrical payload.

13. The tactical carrying pack for back-supported transport of a payload of claim 9 wherein said payload-receiving member includes a walled storage area.

14. The tactical carrying pack for back-supported transport of a payload of claim 9 wherein said payload-receiving member includes a ledge for receiving a back pack or other payload capable of resting on a flat bottom.

15. The tactical carrying pack for back-supported transport of a payload of claim 9 wherein said left shoulder bar and said right shoulder bar include flexible padding at least in shoulder contacting areas.

16. The tactical carrying pack for back-supported transport of a payload of claim 9 wherein said vertical base plate includes a user back pad on its front.

* * * * *